US005794504A

United States Patent [19]

Starbile

[11] Patent Number: 5,794,504

[45] Date of Patent: Aug. 18, 1998

[54] LUBRICATED BRAIDED PACKING AND METHOD OF MAKING SAME

[75] Inventor: Paul Vincent Starbile, Woburn, Mass.

[73] Assignee: Chesterton International, Inc., Stoneham, Mass.

[21] Appl. No.: 530,900

[22] Filed: Sep. 20, 1995

[51] Int. Cl.[6] ..... D06P 7/00

[52] U.S. Cl. ..... 87/1; 87/7; 87/11; 87/13

[58] Field of Search ..... 277/229, 230; 57/7, 232, 258, 295; 87/1, 7, 11, 13

[56] References Cited

U.S. PATENT DOCUMENTS

| | | | |
|---|---|---|---|
| 741,056 | 10/1903 | Montegomery | 277/230 |
| 1,050,184 | 1/1913 | Walker . | |
| 2,562,262 | 7/1951 | De Witt | 87/1 |
| 3,120,960 | 2/1964 | Pippert et al. | 277/230 |
| 3,271,039 | 9/1966 | Kohl et al. | 277/228 |
| 3,306,155 | 2/1967 | Zumeta et al. | 57/258 |
| 3,341,211 | 9/1967 | Houghton et al. | 277/205 |
| 3,646,846 | 3/1972 | Houghton et al. | 87/1 |
| 3,653,295 | 4/1972 | Pintard | 87/1 |
| 3,870,589 | 3/1975 | Shobert | 161/47 |
| 4,100,835 | 7/1978 | Kozlowski | 87/1 |
| 4,256,011 | 3/1981 | Kozlowski | 87/6 |
| 4,298,562 | 11/1981 | Latty | 264/103 |
| 4,333,380 | 6/1982 | Kozlowski | 87/6 |
| 4,949,620 | 8/1990 | Swan et al. | 87/8 |
| 5,225,262 | 7/1993 | Leduc | 277/229 |
| 5,240,769 | 8/1993 | Ueda et al. | 428/365 |

FOREIGN PATENT DOCUMENTS

| | | | |
|---|---|---|---|
| 2255141 | 10/1992 | United Kingdom | 277/230 |

*Primary Examiner*—William Stryjewski
*Attorney, Agent, or Firm*—Lahive & Cockfield, LLP; Ralph A. Loren; Anthony A. Laurentano

[57] ABSTRACT

A braided packing has a number of longitudinal strands around which a braid strand is wound in a lattice pattern to form a substantially square braid. The longitudinal strands include at least two lubricant sink strands, the lubricant sink strands having a material composition and configuration to give the lubricant sink strands a higher lubricant absorbency than the other longitudinal strands and the braid strand. The packing is immersed in a lubricating fluid which is absorbed and retained in higher amounts by the lubricant sink strands, thereby providing a long-lasting source of lubricant for the overall packing during use.

24 Claims, 5 Drawing Sheets

LUBRICATED BRAIDED PACKING AND METHOD OF MAKING SAME

BACKGROUND OF THE INVENTION

1. Field of the Invention

The present invention relates to packing, and specifically to braided packing of the type having a number of longitudinally extending core strands around which a number of braid strands are braided. The present invention also relates to a method for making a packing of this type.

2. Description of the Prior Art

In many types of machines, sealing and packing materials are required which are substantially corrosion-resistant and heat resistant, and which also have a long service life. A particular need for such materials arises in the case of machinery stuffing boxes, for example, for packing a rotary shaft or a reciprocating rod or other moving element at a point where the shaft or rod or element extends through an opening into another part of the machine, the part of the machine into which the shaft or rod or element extends containing some type of fluid which must be held against escape. Braided packing has been found to be particularly useful for packing such a journal, the packing being used to surround the moving element so that movement of the element is permitted, by rubbing against the packing, but substantially no fluid is permitted to pass through the opening due to the presence of the packing.

Commercially available packing, such as products available from Chesterton International, generally include natural fibers such as flax, jute, cotton or others, or man-made fibers such as polytetraflorethyne (PTFE) fibers, which are spun and twisted into yarns, the yarns then being braided or twisted into packing or woven into packing fabrics. It is known to impregnate such packings with liquid lubricants, greases and other lubricating compounds in order to reduce the friction between the packing and the moving part, such lubricants also assisting in the sealing function. It is also known to armor such packing with various metals to further reduce friction as well as to provide a partial or full metallic wearing face for the moving parts.

A fibrous graphite packing is known, for example, from U.S. Pat. No. 3,646,846, formed by an elongated braid of strands of graphite filament yarn, the strands and the interstices therebetween thoroughly impregnated with finely yet divided fluorocarbon resins and solid lubricants having crystal layer lattice structures, such as graphite. A braiding machine for making such a packing is also known from this patent.

Another type of braided packing is disclosed in U.S. Pat. Nos. 4,333,380; 4,256,011 and 4,110,835, which is also of the type initially described in the form of strands braided around a number of longitudinally extending strands. In the packing disclosed in these patents, however, the overall packing product is provided with an exterior helical twist. Machines for making such a packing are also disclosed in these patents.

SUMMARY OF THE INVENTION

It is an object of the present invention to provide a braided packing of the type having a plurality of longitudinally extending strands around which a number of braid strands are braided, which is suitable for packing journals, stuffing boxes and the like wherein the packing rubs against a moving part, with the packing providing superior lubricating and sealing around the moving part.

The above object is achieved in accordance with the principals of the present invention in a packing having a plurality of longitudinally extending strands around which a plurality of braid strands are wound, with certain of the longitudinally extending strands being of a composition which forms an exceptional "lubricant sink" which provides a long-lasting source of liquid lubrication for the overall packing when it is placed in service. The braid strands also have a specially formulated composition which operates in combination with the composition of the "lubricant sink" longitudinally extending strands to hold an even further increased amount of lubricant in the overall packing. The respective compositions of the braid strands and the "lubricant sink" strands operate in concert and combination to increase the overall amount of lubricant which is maintained over an extended period of time in the packing. The increased amount of lubricant which is held in the selected longitudinal strands not only improves the sealing and lubricating functions of the packing, but also increases the service life of the packing, thereby making replacement thereof, as well as re-lubrication less frequent.

The longitudinally extending strands which accept and hold the increased amount of lubricant are a jacketed yarn containing a core formed by a 10 GN, 20 GN or higher weight sliver of 70% acrylic and 30% rayon. The core may also contain a tracer strand, such as one tracer strand of a selected color.

The outer jacket is preferably constructed of four strands of cotton braided to form a tubular jacket.

As noted above, the inventive packing is in the form of a braided packing, such as a square braid, having a plurality of longitudinally extending strands around which the braid (formed by a continuous yarn strand) is wound. The number of longitudinally extending strands can be varied, and the number of strands out of the total of longitudinally extending strands which will be "lubricant sink" strands will vary accordingly. In an embodiment formed on a 20 carrier lattice braider, for example, there will be a total of seven longitudinally extending strands comprised of four corner strands, one center strand and two "lubricant sink" strands. The two "lubricant sink" strands will be respectively disposed at opposite sides of the square braid, between two of the corner strands and approximately in a line with the center strand.

The longitudinally extending strands which are not "lubricant sink" strands are preferably of the same composition as the braid strand. This yarn composition is preferably a Dref 3 construction formed by 50% Kynol and 50% acrylic. This yarn may be of a single ply or double ply construction. All of this yarn is pre-lubricated before being braided into the packing. The aforementioned construction of the braid strands, as well as the other longitudinally extending strands which are not "lubricant sink" strands, is specifically selected to interact with the composition of the "lubricant sink" strands so as to enhance the lubricant absorption and holding capabilities of the overall packing. As a result of the pre-lubrication, the yarn absorbs the lubrication so as to increase its weight by an exceptionally high amount. The pre-lubrication is preferably such as to increase the weight of the yarn by 100% or higher.

In a method for making the packing of the invention, all jacket, corner, warp, and center yarns are pre-lubricated with PTFE so as to provide a weight increase of approximately 100%. The yarns are bobbined and the carriers of a conventional braiding machine are laced depending on the size and configuration of the packing to be made. The "lubricant sink" strands are also bobbined. The product is then braided using standard braiding techniques, and a desired length of the braided product is then cut from the braiding machine. The braided product is squared to have a desired cross-sectional size depending on the particular application.

The squared product is then dipped in break-in fluid, such as white petrolatum, for approximately twenty minutes. This additional immersion of the overall product in liquid lubricant causes the lubricant to impregnate all of the strands of the product, and in particular, the specially constructed "lubricant sink" strands absorb and hold an exceptional amount of lubricant. After immersion, therefore, not only is the entire product lubricated, but the "lubricant sink" strands provide a continuing source of lubricant for a long period of use of the packing, the lubricant from the "lubricant sink" strands flowing and permeating the remainder of the product during use by wicking action as well as due to the compression of the product during use.

After immersion in the break-in fluid, the product is spooled in desired quantities.

DESCRIPTION OF THE PREFERRED EMBODIMENTS

Figure 1:
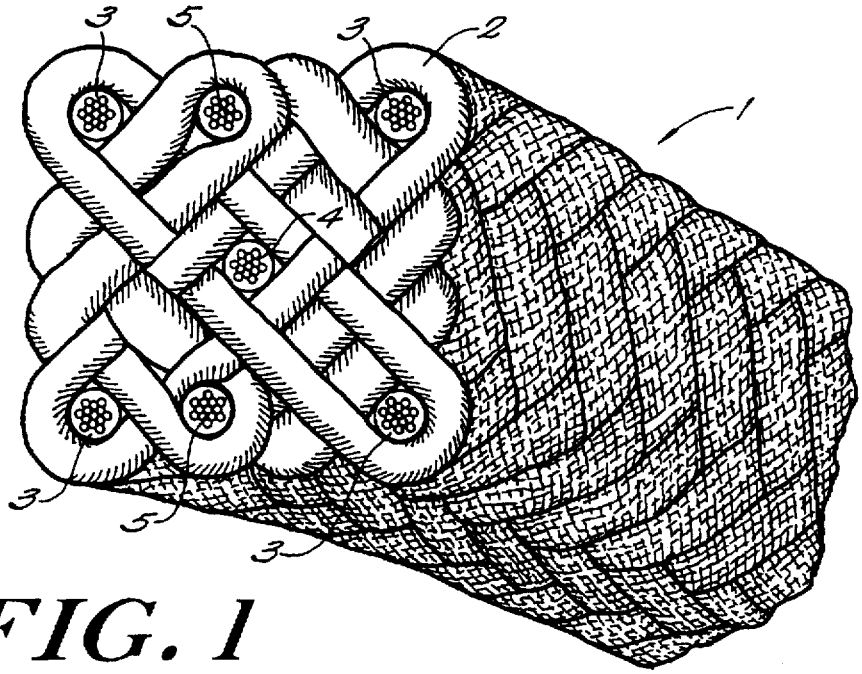
FIG. 1 is an end view of packing constructed in accordance with the principals of the present invention and made in accordance with the method of the present invention.

FIG. 1 shows an end view of braided packing 1 constructed in accordance with the principals of the present invention. The braided packing 1 is shown in FIG. 1 in an embodiment having a square exterior configuration, however, it will be appreciated that the principals of the present invention can be employed for making a packing of any desired exterior shape, depending on the particular application for which the packing 1 is intended to be used.

The braided packing 1 is formed by a plurality of longitudinally extending strands 3, 4, and 5, around which a braid strand 2 is continuously wound to form the lattice pattern shown in FIG. 1, in a known manner on a standard braiding machine. The corner longitudinal strands 3 and the center longitudinal strand 4 are preferably yarn having the same composition and structure as the braid strand 2 (shown in detail in FIG. 2, and described below), and the longitudinally extending strands 5 are specially designed "lubricant sink" strands, which accept and hold an exceptional amount of lubricant. The details of the structure of the "lubricant sink" strands 5 are shown in FIG. 3, and described below. In the embodiment of FIG. 1, produced on a 20 carrier braiding machine, the "lubricant sink" strands 5 are disposed on opposite sides of the braided packing 1, between two of the corner strands 3 and approximately in-line with the center strand 4. It will be appreciated, however, that if other braiding configurations are used, more longitudinal strands may be present, and the increased number of longitudinal strands will also include an increased number of "lubricant sink" strands 5. Another possible configuration embodiment, for example, has a "lubricant sink" strand 5 at each of the sides of the braided packing one with each "lubricant sink" strand 5 being disposed between two of the corner strands 3 and being approximately in-line with a center strand 4.

Figure 2:
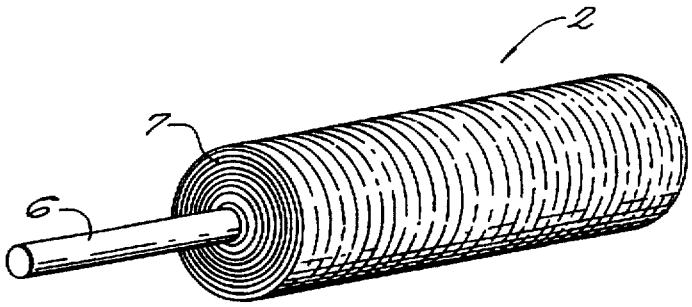
FIG. 2 is a perspective view showing the structure of the strands which are used as the braided strand, the corner strands and the center strands in the packing of FIG. 1.
Figure 3:
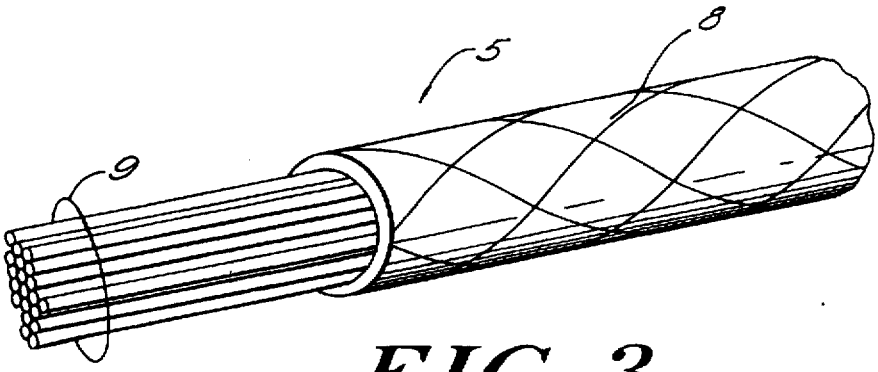
FIG. 3 is a perspective view showing the structure of the "lubricant sink" strands in the packing of FIG. 1.

The details of structure of the braid strand 2, the corner strands 3 and the center strand 4 are shown in FIG. 2. All of those strands preferably have the same specially designed construction, exemplified by the braid strand 2 shown in FIG. 2. The braid strand 2, as well as the corner strands 3 and the center strand 4, comprise a Dref 3 construction yarn formed by 50% Kynol (preferably Novoloid fiber) and 50% acrylic (preferably Ricem fiber). This fiber combination 7 is wound or twisted around a fiberglass core 6. The yarn may be one ply or double ply construction. All of the yarn forming the braid strand 2, the corner strands 3 and the center strand 4 is pre-lubricated, such as with PTFE, so as to increase the weight thereof by 100% or higher.

The structure of a "lubricant sink" strand 5 is shown in detail in FIG. 3. The "lubricant sink" strand 5 is formed by a cotton jacket 8 surrounding a core 9 consisting of a plurality of fibers. The "lubricant sink" strand 5 may be formed on a 2NBA knit braider 4 needle machine. The outer jacket 8 is a cotton jacket constructed of four strands of cotton braided to form a tubular jacket. The cotton is preferably 12/1 cotton count or 400 denier ±6%.

The core 9 of fibers preferably consists of a 10 GN or higher weight sliver with the fibers having a composition of approximately 70% acrylic and 30% rayon.

The above-described composition of the braid strand 2 (and the other non "lubricant sink" strands) and the composition of the "lubricant sink" strand 5, in addition to being devised to individually improve the lubricant absorption and retention of those respective strands, are also selected so that the respective strands operate in concert and combination so that the overall braided packing embodying the braid strand 2 and the "lubricant sink" strand 5 has enhanced lubricant absorption and retention capabilities. Although the aforementioned composition of the braid strand 2 (and the other non "lubricant sink" strands) can be used by itself, with a conventional longitudinal strand, and a "lubricant sink" strand 5 of the above composition can be used with conventional braid strands, best results are achieved when braid strands and "lubricant sink" strands having the above respective compositions are used together in the same braided packing.

The core 9 of fibers may also include a tracer strand, which may be a single strand of a selected color, such as green.

The "lubricant sink" strand 5 is knitted separately, before being placed into the braiding machine. Depending on the size of the overall braided packing 1 to be produced, different sizes of knitting machines will be used to produce the "lubricant sink" strand 5. One machine may be an 8 gauge machine for sizes from ⅛" to ½", another machine may be a 12 gauge machine for sizes from 9/16" to 1".

Figure 4:
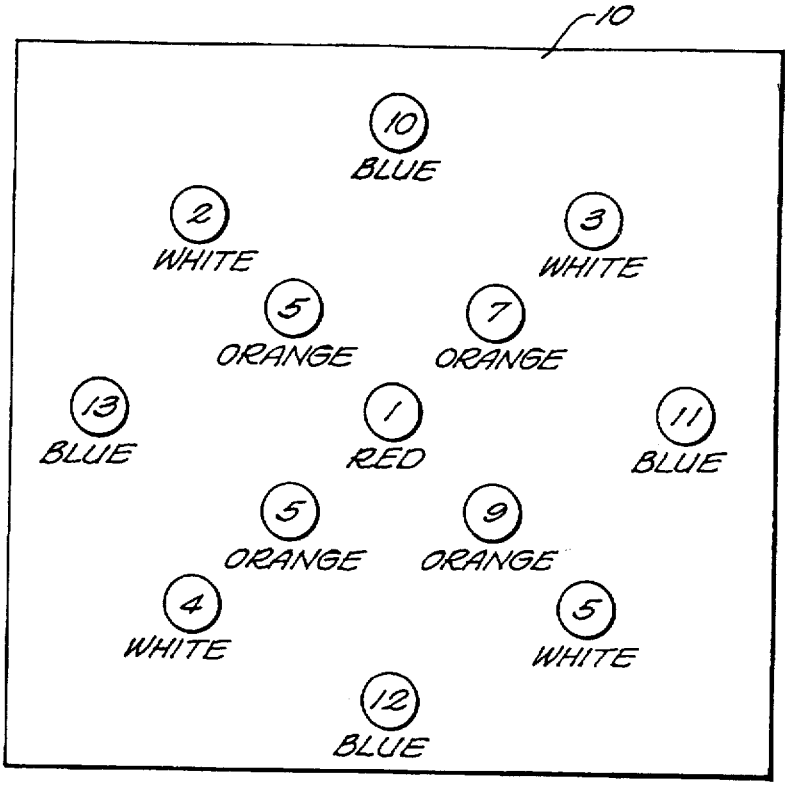
FIG. 4 is a braiding chart showing the respective positions of the strands for braiding the product shown in FIG. 1 on a 20 carrier braiding machine.
Figure 5:
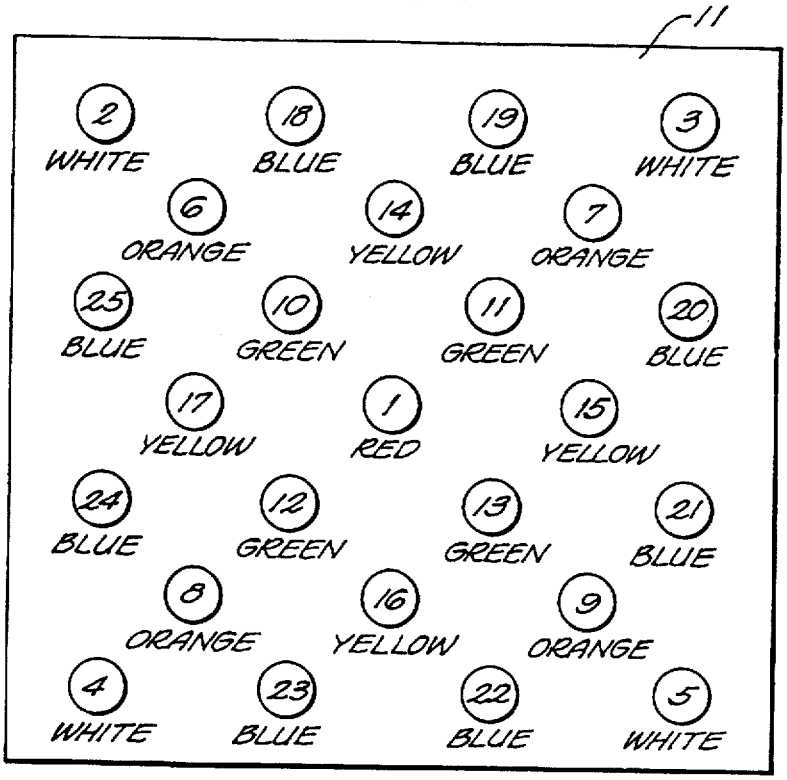
FIG. 5 is a braiding chart showing the respective positions of the strands for braiding a further embodiment of the product shown in FIG. 1 on a 36 carrier braiding machine.
Figure 6:
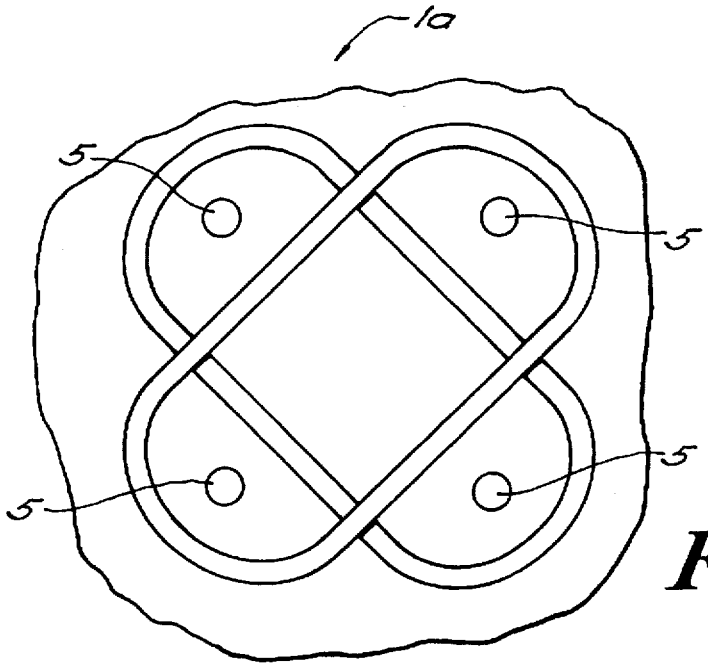
FIGS. 6, 7, 8 and 9 respectively show exemplary placement locations of "lubricant sink" strands in various square braided packing configurations.
Figure 7:
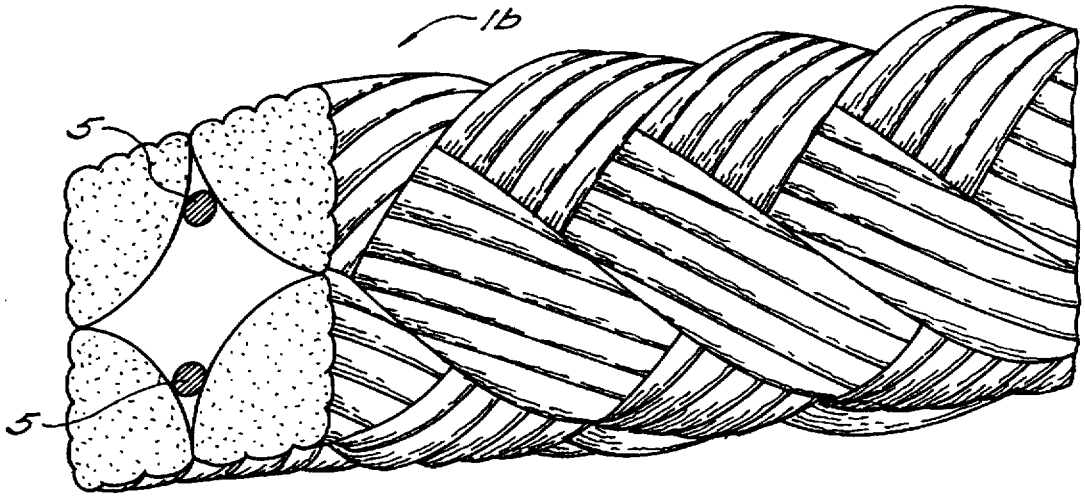
Figure 8:
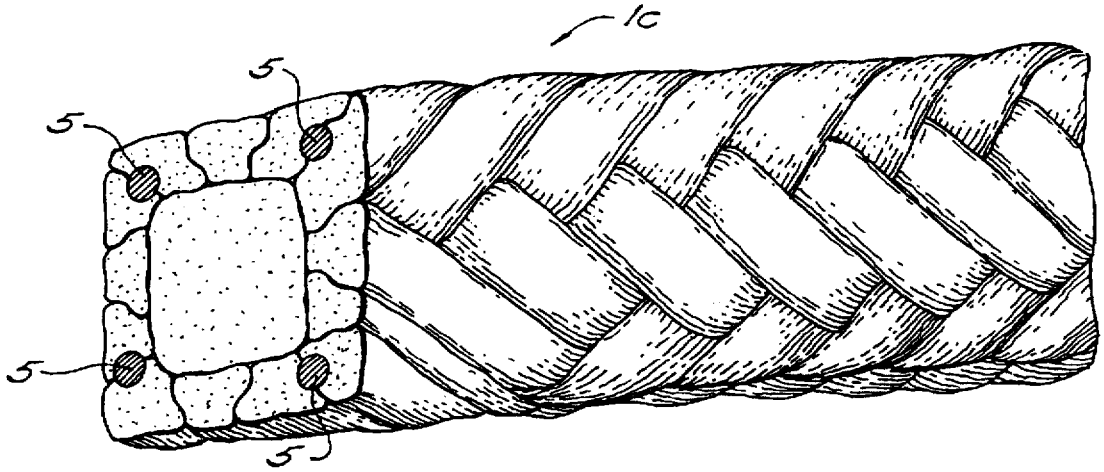
Figure 9:
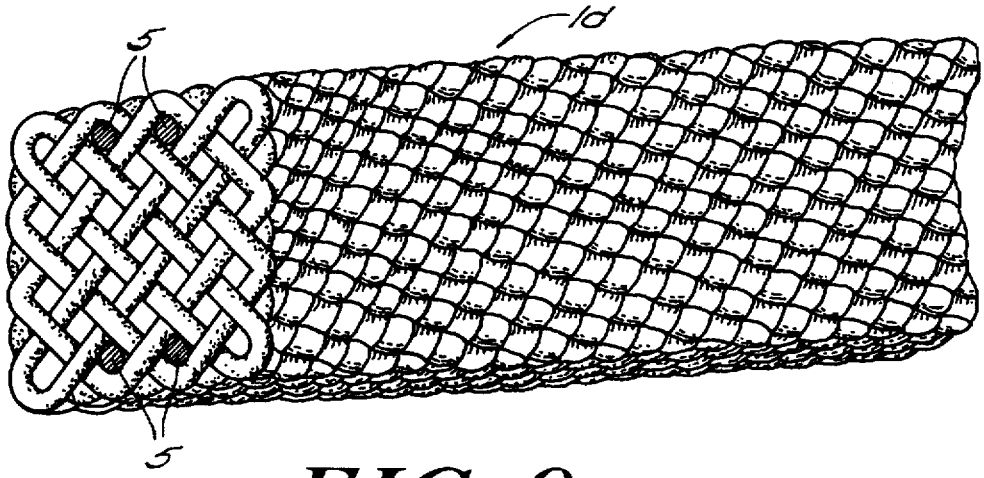

The braided packing 1 is produced on a standard braiding machine of the type disclosed, for example, in the aforementioned U.S. Pat. Nos. 4,333,380; 4,256,011; 4,100,835 and 3,646,846, the teachings of which are incorporated herein by reference. Exemplary braiding charts are shown in FIGS. 4 and 5, the braiding chart 10 shown in FIG. 4 being for a 20 carrier lattice braider and the braiding chart 11 shown in FIG. 5 being for a 36 carrier lattice braider. The numbers shown thereon inside the circles refer to the post numbers and do not relate to the numbers shown in FIGS. 1, 2, and 3. In the braiding chart shown in FIG. 4, the center strand is indicated as red, the corner strands are indicated as white, and the warps are indicated as blue and orange, with the blue strands being the "lubricant sink" strands 5. In the braiding chart shown in FIG. 5, the center strand is again indicated as red, the corner strands are again indicated as white, and the warps are indicated as blue, orange, yellow and green, with the blue strands again being the "lubricant sink" strands 5.

For making the braided product, the strands which are to form the "lubricant sink" strands 5 are separately knitted as described above. All jacket, corner, warp and center strands are pre-lubricated with PTFE so as to increase the weight thereof by approximately 100%. The material is bobbined per specifications, depending on the type of product to be made and the braiding machine is laced according to one of the charts shown in FIGS. 4 and 5. A 20 carrier lattice braiding machine will produce, for example, a product having a ⅛" cross-section. The product is then braided using a machine of the type described in the aforementioned patents in a standard braiding method. A desired length of the braided product is then cut from the braiding machine, and this product is squared to size depending on the particular application. The squared, braided product is then immersed in break-in fluid, such as white petrolatum, for approximately 20 minutes. In addition to the lubricant absorbed in the aforementioned pre-lubrication step, the additional immersion in liquid lubricant after the product has been braided allows all of the strands, and in particular the "lubricant sink" strands 5, to become further impregnated with lubricant. Because of the specially designed construction of the "lubricant sink" strands 5, they will absorb and hold an exceptional amount of lubricant, thus serving as a source of lubricant for the overall braided packing 1 during its use. The lubricant held in the "lubricant sink" strands 5 will be gradually released during the overall service life of the packing 1, due to wicking into the remaining yarns of the product, as well as due to compression of the braided packing 1 during use.

The braided product is then removed from the break-in fluid and is spooled on a spool of appropriate size, such as a 2, 5, or 10 pound spool.

FIGS. 6, 7, 8 and 9 respectively show various further embodiments 1*a*, 1*b*, 1*c* and 1*d* of square braided packing. In each of these embodiments, a suggested, exemplary location of the "lubricant sink" strands 5 has been indicated, although other placement possibilities exist. In each embodiment, the remainder of the strands employed for making the square braided packing, or substantially all of the remainder of those strands, have a composition as described above in connection with the braid strand 2, operating in combination with the "lubricant sink" strands 5 to provide enhanced lubricant absorption and retention capabilities as described above.

Figure 10:
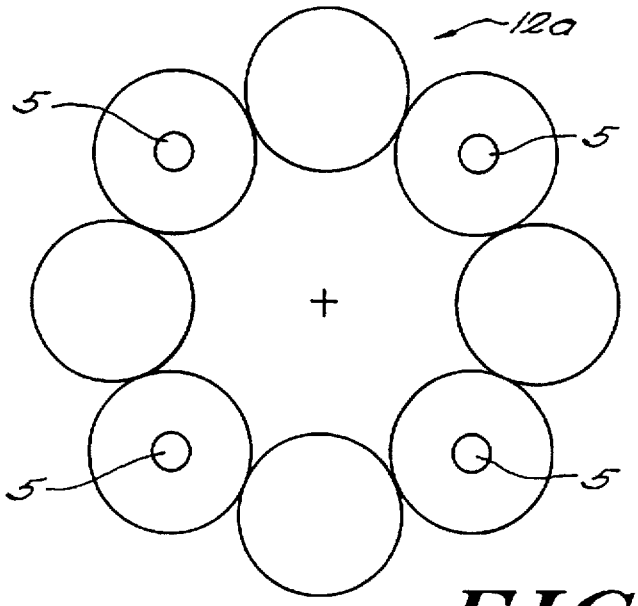
FIGS. 10 and 11 respectively show exemplary placement locations of "lubricant sink" strands in two sizes of circular braided packing.
Figure 11:
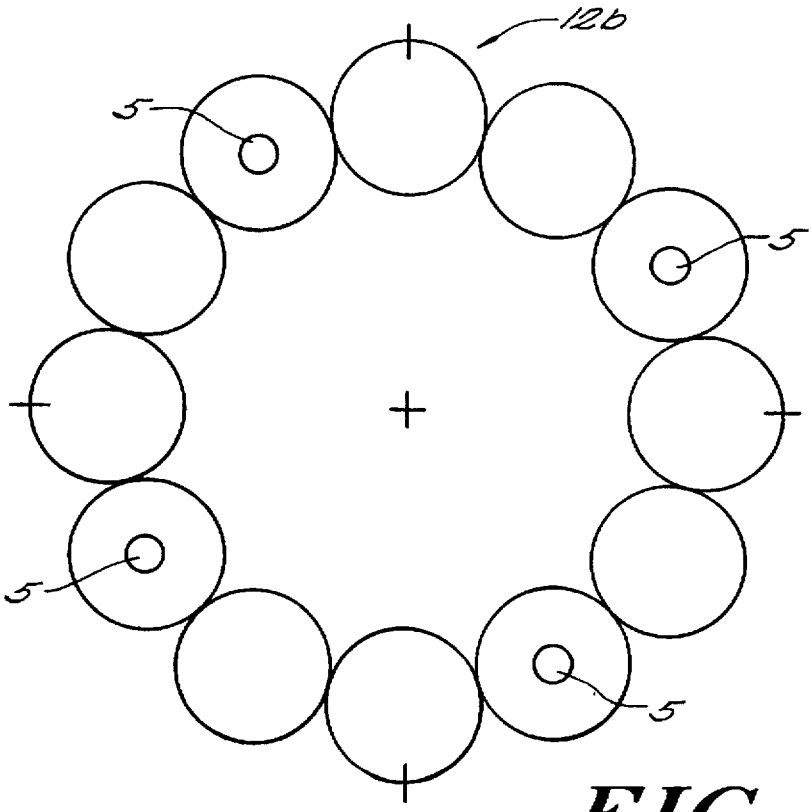

Two embodiments for circular packing are respectively shown in FIGS. 10 and 11, a smaller diameter version 12*a* being shown in FIG. 10 and a larger diameter version 12*b* being shown in FIG. 11. Again, suggested exemplary locations for the "lubricant sink" strands 5 are indicated, with other placement possibilities again existing. FIGS. 10 and 11 schematically indicate the outer layer of braids, however, it will be understood that, except for the composition of the "lubricant sink" strands 5 and the braid strands as described above, in order to provide the enhanced lubricant retention and absorption capabilities, the circuit braided packing embodiments shown in FIGS. 10 and 11 are manufactured using conventional braiding machines, and therefore further details as to their manufacture need not be described. The same pre-lubricating and lubricating steps as described above in connection with the inventive method, however, are employed in addition to the conventional braiding steps.

Because of the increased amount of lubricant which is retained in the braided packing of each embodiment 1 by virtue of the inclusion of the "lubricant sink" strands 5 therein, the braided packing of all embodiments provides exceptional lubricating and sealing functions when employed in a stuffing box or journal surrounding a moving part. The braided packing constructed and produced as described herein permits the moving part to operate at a lower temperature, since less friction is present, thereby increasing the service life of the moving part due to decreased wear. As noted above, the braided packing of the invention also has a longer service life itself, and the length of time which the braided packing of the invention can be used without re-lubrication, by the external application of a lubricant, is significantly longer. The journal or stuffing box in which the braided packing of the invention is used, therefore, requires less frequent manual attention.

Moreover, the braided packing 1 is manufactured using standard braiding machines and techniques, and therefore does not require the purchase or construction of a specially designed machine to produce the product. This enables the braided packing 1 to be manufactured at a relatively low cost, comparable to that for conventional braided packing.

Although modifications and changes may be suggested skilled in the art, it is the intention of the inventor to embody within the patent warranted hereon all changes and modifications as reasonably and properly come within the scope of his contribution to the art.

I claim as my invention:

1. A braided packing comprising:

a plurality of longitudinal strands;

a braid strand wound around said longitudinal strands in a selected pattern and thereby forming a braid having an initial weight, said braid strand including yarn having a fiber glass core with fibers wound thereon, said fibers including approximately 50% Kynol and approximately 50% acrylic; and lubricant impregnated in said braid in an amount increasing the weight of said braid by at least 100% of said initial weight.

2. A braided packing as claimed in claim 1 wherein at least one of said longitudinal strands comprises:

a tubular cotton jacket; and a plurality of core fibers contained within said cotton jacket.

3. A braided packing as claimed in claim 2 wherein said plurality of core fibers comprises approximately 70% acrylic and approximately 30% rayon.

4. A braided packing as claimed in claim 1, wherein said selected pattern forms a substantially square braid having four sides, and wherein said longitudinal strands comprises four lubricant sink strands arranged such that two lubricant sink strands are disposed on opposite sides of said square braid.

5. A braided packing as claimed in claim 4, wherein said lubricant sink strands have a material composition and configuration having a higher lubricant absorbency relative to said braid strand.

6. A braided packing as claimed in claim 4, wherein each lubricant sink strand comprises a tubular cotton jacket; and a plurality of core fibers contained within said cotton jacket.

7. A braided packing as claimed in claim 6, wherein said plurality of core fibers comprises approximately 70% acrylic and approximately 30% rayon.

8. A braided packing as claimed in claim 6, wherein said plurality of core fibers includes a tracer strand.

9. A braided packing as claimed in claim 8, wherein said tracer strand comprises a polytetrafluoroethylene strand of a selected color.

10. A braided packing as claimed in claim 4, wherein each of said lubricant sink strands comprises:

a cotton jacket having four cotton strands, and a plurality of core fibers surrounded by said cotton jacket, said plurality of core fibers being composed of approximately 70% acrylic and approximately 30% rayon, and a tracer strand.

11. A braided packing as claimed in claim 1, wherein said longitudinal strand includes at least one lubricant sink strand, wherein said lubricant sink strand and said braid strand are impregnated with break-in fluid, said lubricant sink strand being configured to retain and absorb an increased amount of break-in fluid compared to said braid strand.

12. A braided packing as claimed in claim 1, wherein said longitudinal strand includes at least one lubricant sink having means for providing lubricant for extended periods of time.

13. A braided packing as claimed in claim 1, wherein said longitudinal strand includes at least one lubricant sink strand, and wherein said lubricant sink strand operates in combination with said braid strand to hold an increased amount of lubricant, such that said initial weight of said packing is increased by said at least 100%.

14. A method for producing braided packing, comprising providing a plurality of longitudinal strands, providing a braided strand wound around said longitudinal strands in a selected pattern, thereby forming a braid having an initial weight, the step of providing a braid strand including the step of forming said braid stand from yarn having a fiberglass core with fibers wound thereon, wherein said fibers include approximately 50% Kynol and approximately 50% acrylic; and impregnating said packing with a lubricant in a selected amount thereby increasing the weight of said braid by at least 100% of said initial weight.

15. The method of claim 14, wherein the step of providing a plurality of longitudinal strands includes the step of forming said longitudinal strand with a tubular cotton jacket; and a plurality of core fibers contained within said cotton jacket.

16. The method of claim 15, wherein the step of providing a plurality of longitudinal strand further includes the step of forming said plurality of core fibers from approximately 70% acrylic and approximately 30% rayon.

17. The method of claim 14, wherein the step of providing a braid strands includes the step of forming a substantially square pattern having four sides, wherein said longitudinal strands include a plurality of lubricant sink strands arranged on opposite sides of said square braid.

18. The method of claim 17, wherein the step of providing a braid strands further includes the step of forming said lubricant sink strands from material having a higher lubricant absorbency relative to said braid strand.

19. The method of claim 18, wherein the step of providing a braid strands further includes the step of forming each lubricant sink strand from a tubular cotton jacket; and a plurality of core fibers contained within said cotton jacket formed of approximately 70% acrylic and approximately 30% rayon.

20. The method of claim 19, further comprising the step of forming said lubricant strand with a tracer strand of a selected color.

21. The method of claim 14, wherein said longitudinal strand includes at least one lubricant sink strand, and wherein said step of impregnating further comprises the step of impregnating said lubricant sink strand and said braid strand with a lubricant, such that said lubricant sink strand retains and absorbs an increased amount of the lubricant relative to said braid strand.

22. The method of claim 14, wherein said longitudinal strand includes at least one lubricant sink strand, further comprising the step of providing lubricant for extended periods of time.

23. The method of claim 14, wherein said longitudinal strand includes at least one lubricant sink strand, and wherein said lubricant sink strand operates in combination with said braid strand to hold an increased amount of lubricant, such that said initial weight of said packing is increased by said at least 100%.

24. The method of claim 14, wherein the step of impregnating further comprises the step of immersing said packing in white petrolatum.

* * * * *

UNITED STATES PATENT AND TRADEMARK OFFICE

CERTIFICATE OF CORRECTION

PATENT NO. : 5,794,504

DATED : August 18, 1998

INVENTOR(S) : Paul Vincent Starbile

It is certified that error appears in the above-identified patent and that said Letters Patent is hereby corrected as shown below:

Column 7, line 41, replace "braided" with --braid-- as found in the Amendment dated June 24, 1997 on page 4.

Signed and Sealed this

Twenty-eighth Day of December, 1999

*Attest:*

Q. TODD DICKINSON

*Attesting Officer*

*Acting Commissioner of Patents and Trademarks*